United States Patent [19]

Hénault

[11] Patent Number: 4,651,710

[45] Date of Patent: Mar. 24, 1987

[54] DEVICE FOR MOUNTING A GAS HEATER ON A WALL FOR CONNECTION WITH THE EXTERIOR

[75] Inventor: Jean-Paul Hénault, Bourseville, France

[73] Assignee: Societe Industrielle Auer, Pantin, France

[21] Appl. No.: 799,495

[22] Filed: Nov. 19, 1985

[30] Foreign Application Priority Data

Nov. 19, 1984 [FR] France ..... 84 17609

[51] Int. Cl.[4] ..... F24C 3/00

[52] U.S. Cl. ..... 126/85 B; 126/116 B; 98/63

[58] Field of Search ..... 126/85 R, 85 B, 307 R, 126/307 A, 312, 110, 110 B, 116, 116 B; 98/62, 48, 60, 36

[56] References Cited

U.S. PATENT DOCUMENTS

| | | | |
|---|---|---|---|
| 2,120,211 | 6/1938 | Cornell, Jr. | 126/85 B |
| 2,964,034 | 12/1960 | Nordholt et al. | 126/85 B |
| 3,091,223 | 5/1963 | Vitale | 126/85 B |
| 3,136,309 | 6/1964 | Martz | 126/85 B |
| 3,446,202 | 5/1969 | Cooper et al. | 126/85 B |
| 3,552,377 | 1/1971 | Hodges | 126/85 B |

FOREIGN PATENT DOCUMENTS

| | | | |
|---|---|---|---|
| 215119 | 10/1980 | Austria | 126/85 B |
| 1023996 | 3/1966 | United Kingdom | 126/85 B |
| 1216305 | 12/1970 | United Kingdom | 126/85 B |

*Primary Examiner*—James C. Yeung

*Attorney, Agent, or Firm*—Charles E. Brown; Charles A. Brown

[57] ABSTRACT

A device for mounting a gas-fired heating apparatus on a wall and connecting it through a flue for communication with the outside of the wall. The flue comprises inner and outer coaxial tubular members defining inner and outer conduits for carrying combustion supporting air from the exterior to the heating apparatus and combustion gases from the heating apparatus to the exterior. A register admitting combustion supporting air and venting combustion gases is fitted at the free end of the flue remote from the heating apparatus. A support plate has a circular aperture in a base for locating the support plate on the outer coaxial tubular member and wings cooperable with fittings on the heating apparatus for supporting the heating apparatus. A gasket with a retaining collar is received along a portion of the support plate and tightened on the outer coaxial tubular member.

3 Claims, 5 Drawing Figures

FIG.1
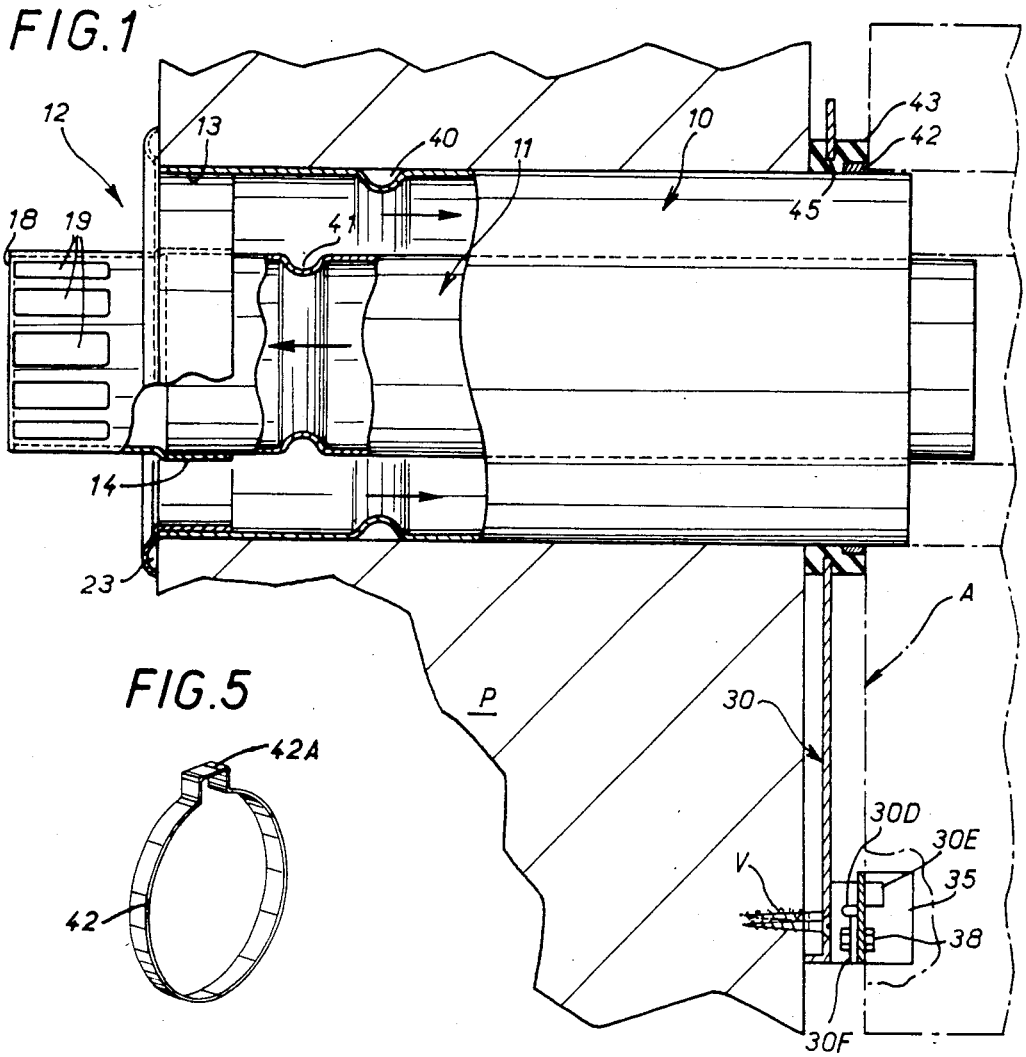
FIG.5
FIG.3
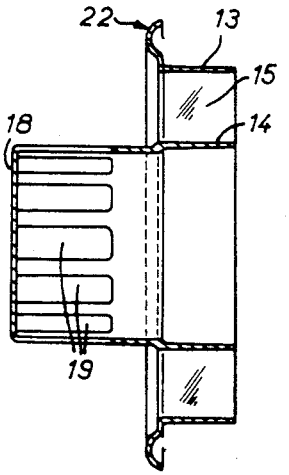
FIG.2
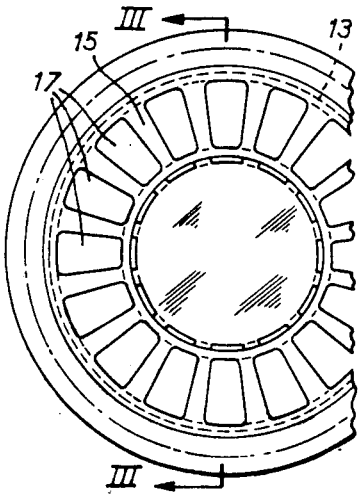
FIG.4
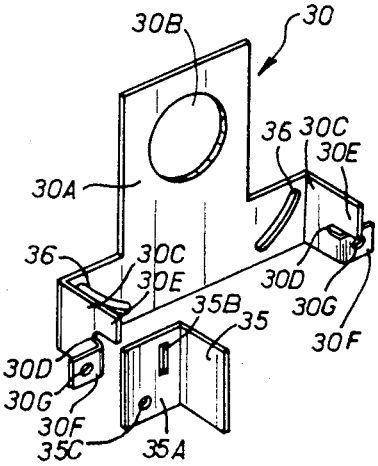

DEVICE FOR MOUNTING A GAS HEATER ON A WALL FOR CONNECTION WITH THE EXTERIOR

FIELD OF THE INVENTION

The present invention relates generally to so-called sealed or air-tight gas-fired heating apparatus and more particularly a device for mounting such a heating apparatus on a wall for communication with the exterior.

To connect such an apparatus with the exterior it has usually been proposed to equip the same with a flue.

Such flues comprise two coaxial tubular members adapted to be received in an opening in an exterior wall of a building. At the end of the tubular member it is equipped with a register or flue nozzle and at the other end it is connected to the heating apparatus which is mounted on the wall.

At the present time the mounting and assembling of the flue nozzle and the heating apparatus are relatively time-consuming which increases the installation cost. Further, it has been observed that the air-tightness of the flue between the exterior and the interior is less than satisfactory and depends on the exposure of the flue.

OBJECT AND SUMMARY OF THE INVENTION

An object of the invention is to provide a device for mounting a heating apparatus on a wall which substantially reduces the foregoing problems.

According to the invention the device for connecting the heating apparatus to the exterior through a wall is of the type comprising a flue having coaxial tubular members defining inner and outer conduits, one of the conduits being for the admission of combustion supporting air and the other of the conduits exhausting combustion gases. One of the ends of the flue is connected to the heating apparatus and the other opens to the ambient atmosphere through the register or flue nozzle at the free end of the flue.

According to the improvement, a register is fitted at the free end of the flue for admission of combustion supporting air and venting of combustion gases. A support plate having an aperture locates the support on the outer coaxial tubular member. Means are provided for fixing the support plate to the wall. The support plate has means cooperable with fittings on the heating apparatus for supporting the heating apparatus thereon.

The installation of the airtight heating apparatus of the present invention is comparatively simpler than known arrangements particularly because of the fact that the support plate for the heating apparatus is automatically located by fitting interengagement on the outer coaxial member and then fixed to the wall in the usual fashion. The support plate may be axially restrained against movement on the flue by means of a retaining collar. It will be appreciated that the installation of the airtight heating apparatus will be limited to simple operations such as drilling and assembly which may be quickly performed by even semi-skilled workers.

As regards air-tightness, the advantageously one-piece register, the flue with coaxial tubular members and the installation of the heating apparatus on the flue enable the use and fitting of effective sealing means.

BRIEF DESCRIPTION OF THE DRAWINGS

These and other features and advantages of the invention will be brought out in the description of the invention which follows, by way of example, with reference to the accompanying drawings.

FIG. 1 is an elevational view, partly in section, of the mounting device embodying the present invention;

FIG. 2 is a partial end view of the register or flue nozzle;

FIG. 3 is a cross-sectional view of the register or flue nozzle, taken along line III—III in FIG. 2;

FIG. 4 is a perspective view of the support plate including means for automatically locating the heating apparatus and its securement on the support plate; and FIG. 5 is a perspective view of the retaining collar taken on its own.

DESCRIPTION OF THE PREFERRED EMBODIMENT

In the illustrated embodiment the device according to the invention is mounted in an exterior wall P of a building and comprises a flue including a register or flue nozzle 12 and two coaxial tubular members, that is an inner tubular member 10 and an outer tubular member 11.

The flue nozzle or register 12 is of preferably a one-piece casting comprising a first or outer skirt 13 and a second or inner skirt 14 interconnected by radial spokes regularly angularly spaced from each other to form a plurality of identical circumferentially spaced passageways 17. The inner skirt 14 has a projecting portion protruding outwardly beyond the outer skirt 13 having a closed end wall 18. In the terminal part of the projecting portion there are provided circumferentially spaced longitudinal slots 19. The outer skirt 13 comprises at its terminal end an outwardly extending annular flange 22 having a hollow annular bead 22 adapted to define a recess for housing a sealing member 23 (FIG. 1). The outer surface of the bead 22 prevents flow of rain water along the outer side of the wall from penetrating inside the register 12.

Such a register is of relatively high mechanical strength, and is impact resistant.

Finally, any defect or irregularity in the hole drilled through the wall P is covered by the annular flange 22, to aesthetic and structural advantage.

The device according to the invention comprises a support plate 30 best illustrated in FIG. 4. The support plate 30 advantageously is made of steel metal and comprises a base 30A having an aperture 30B. The base 30A also comprises, spaced from the aperture 30B, means for fixing the support plate 30 on the wall P. The means for fixing the support plate 30 comprises in the illustrated embodiment arcuate slots 36 whose center coincides with that of the aperture 30B.

Two upstanding wings 30C lie in parallel planes perpendicular to the plane of the base 30A. Each has an outwardly opening notch between a tab 30E in the plane of the associated wing 30C and a lug 30G bent outwardly perpendicular to the plane of the wing.

The airtight or sealed gas-fired heating apparatus A is of known construction and is only partly illustrated in phantom lines. The heating apparatus has at the lower portion of its rear face two lateral angle irons or fittings 35 (only one illustrated) each comprising a leg 35A having vertical slot 35B and a hole 35C laterally offset therefrom. The vertical slots 35B are adapted to be snugly received on the tabs 30E of wings 30C. Holes 35G are adapted to register with holes 30G in the lugs 30F of the wings 30C.

Toward the end in which the register 12 is adapted to be fitted, the coaxial members 10 and 11 have annnular indentations 40 and 41 axially spaced from each other so that the indentation 40 is farther from the outer side of the wall P.

The device according to the invention also comprises a retaining collar 42 adapted to restrain the flue against axial movement in the wall P. The collar 42 is associated with a gasket 43 adapted to cooperate with the outer coaxial member 10 between the inside surface of the wall and the heating apparatus A. The gasket 43 has an outwardly opening annular groove 45 adapted to engage the portion of the base 30A defining the aperture 30B.

The flue and heating apparatus A are mounted as now described.

The register or flue nozzle 12 is tightly fitted into the outer end of the outer coaxial member 10 and the assembled unit is inserted into the hole previously drilled through the exterior wall P. The sealing member (not shown) is previously fitted into the recess 23 of flange 22.

The gasket 43 is fitted around the aperture 30B in the base 30A and then the support plate 30, with the gasket 43, is inserted on the outer coaxial member 10. The outer coaxial member 10 and the support plate 30 are fixed relative to each other by the retaining collar 42 which is tightened on the outer coaxial member 10. To this end the retaining collar 42 has a key portion 42A which is crimped circumferentially to shorten its circumference. To have access to the key portion 42A of the retaining collar 42 the overlying zone of the gasket 43 (preferably made of rubber foam) is temporarily rolled back out of the way. Once the crimping tool (not shown) is removed the overlying zone of the gasket 43 resumes its original position. The tightening of the retaining collar 42 prevents further axial displacement of the gasket 43 (and thereby the support plate 30) relative to the outer coaxial member 10. The inner coaxial member 11 is then fitted inside the inner skirt 14 of the register 12 and cut to the desired length.

The sealing member in the recess 23 and the gasket 43 define fluid-tightness between the wall P and the outer coaxial member 10. The annular indentations 40 and 41 form dams of sorts for impeding the flow of rain water from the exterior through the hole in the wall P.

The support plate 30 is then readily and suitably oriented by slight angular displacement about the outer coaxial member 10 to a vertical position. The support plate 30 is fixed by screws V through slots 36. Thereupon the heating apparatus A is received on the coaxial tubular members 10 and 11 of the flue and fixed to the support plate 30 by engagement of the angle irons 35 onto the lugs 30E on the wings 30C of the support plate 30. Threaded fasteners 38 through holes 30G and 30C secure the heating apparatus A after it is suspended from the coaxial members of the flue and the lower fittings.

It will be readily understood that the mounting and assembly of the present device is particularly simple and virtually foolproof since the mounting of the support plate 30 is ensured by the slight angular movement of the same about the outer coaxial member 10 which avoids the necessity of locating the heating apparatus A relative to the flue which heretofore has been a matter of trial and error with the attendant drawbacks. The support plate in combination with the flue thus ensures the location of the heating apparatus and facilitates its securement thereon.

The combustion support air is admitted through the annular space between the coaxial members 10 and 11 and the combustion gases are exhausted to the surroundings via the central conduit defined by the inner tubular member 11.

The present invention is not limited to the illustrated and described embodiment but encompasses all alternatives and modifications understood to those skilled in the art without departing from the scope of the present invention.

What I claim is:

1. A device for mounting a gas-fired heating apparatus on a wall and connecting the heating apparatus through a flue for communication with the outside of the wall, the flue comprising inner and outer coaxial tubular members defining inner and outer conduits for carrying combustion supporting air from the exterior to the heating apparatus and combustion gases from the heating apparatus to the exterior, a register for admission of combustion supporting air and venting of combustion gases fitted at the free end of said flue remote from the heating apparatus, a support plate having an aperture for locating the support plate on said outer coaxial tubular member, means for fixing said support plate to the wall, said support plate having means cooperable with fittings on the heating apparatus for supporting the heating apparatus, said support plate comprising a base in which said aperture is defined and a pair of laterally spaced wings generally at right angles to said base, and said means being cooperable with the fittings on the heating apparatus being formed on said wings.

2. A device according to claim 1, wherein the fittings have vertical slots and said wings have projecting tabs engageable into the vertical slots.

3. A device according to claim 2, wherein each of the fittings has a hole adapted to come into register with a hole defined in a lug joined and at right angles to the general plane of the associated wing for fixing said heating apparatus.

* * * * *